United States Patent [19]

Van Elderen et al.

[11] Patent Number: 4,875,459

[45] Date of Patent: Oct. 24, 1989

[54] GATTLING-LIKE GUN

[75] Inventors: Daniel N. Van Elderen, Los Altos Hills; Gerald J. Lichac, Santa Cruz, both of Calif.

[73] Assignee: 501 Atari Games, Milpitas, Calif.

[21] Appl. No.: 95,746

[22] Filed: Sep. 11, 1987

[51] Int. Cl.[4] ..... F41B 1/00

[52] U.S. Cl. ..... 124/49; 124/1; 124/51 R; 124/78; 273/356

[58] Field of Search ..... 124/1, 6, 78, 51 R, 124/49, 82; 273/356, 405, 129 R, 129 X, 129 W

[56] References Cited

U.S. PATENT DOCUMENTS

| | | | |
|---|---|---|---|
| 653,749 | 7/1900 | MacKay | 124/49 X |
| 659,555 | 10/1900 | Shuster | 124/51 R X |
| 1,211,738 | 1/1917 | Marty | 124/78 X |
| 1,611,814 | 12/1926 | Butler | 124/78 |
| 2,729,206 | 1/1956 | Wilson | 124/78 |
| 2,845,055 | 7/1958 | Collins et al. | 124/51 R X |
| 3,009,703 | 11/1961 | Jentsch et al. | 124/72 X |
| 3,034,785 | 5/1962 | Graham | 124/36 X |
| 3,787,052 | 1/1974 | Glass | 124/49 X |
| 3,830,500 | 8/1974 | Ventura | 124/49 X |
| 4,025,071 | 5/1977 | Hodges | 124/51 R X |
| 4,185,824 | 1/1980 | Natwick | 124/51 A X |
| 4,225,140 | 9/1980 | D'Andrade et al. | 124/53 X |
| 4,559,918 | 12/1985 | Ballerin et al. | 124/51 A X |
| 4,807,886 | 2/1989 | Van Elderen et al. | 124/6 |

FOREIGN PATENT DOCUMENTS

| | | | |
|---|---|---|---|
| 3040232 | 5/1981 | Fed. Rep. of Germany | 124/51 R |

*Primary Examiner*—Randolph A. Reese
*Assistant Examiner*—Anthony Knight
*Attorney, Agent, or Firm*—Irell & Manella

[57] ABSTRACT

A Gattling-like gun provides for manual control of the rate of firing of projectiles in the form of balls. The balls are fed through two successive nip regions formed by pinch rollers. The first is manually controlled by a crank to vary the rate of firing. Balls delivered from the first nip region are fired at high speed by a fast rotating, fixed speed second pinch roller. The gun fires balls at round targets supported on rotating carousels. Dislodged targets roll to the front of an enclosure for dispensing to the player. The balls are separated and fed by an Archimides' spiral to a feed tube connected to the gun.

3 Claims, 4 Drawing Sheets

GATTLING-LIKE GUN

FIELD OF THE INVENTION

This invention relates to a gun for use in amusement games or other devices, and in particular to such a gun wherein the rate of firing is controllable. This application is related to our copending application Ser. No. 07/095,600 filed Sept. 11, 1987 and entitled "Amusement Game with Dispensed Targets" now U.S. Pat. No. 4,807,886.

BACKGROUND OF THE INVENTION

Many forms of guns have been developed with which to direct or propel a projectile toward a target. Ball throwing devices have been developed which project a ball into a play region, such as a tennis court or batter's box. Such devices are generally complex and are set at predetermined firing rates. Others are trigger operated to fire a single ball or projectile each time the trigger is pulled.

For instance U.S. Pat. Nos. 1,611,814 issued to Buttler; 2,845,055 issued to Collins et al.; 3,009,703 issued to Jentsch et al.; 3,034,785 issued to Graham; 4,185,824 issued to Natwick; and 4,225,140 issued to D'Andrade et al. illustrate shooting devices that use a trigger to fire a projectile each time a trigger is pulled. Butler shows a device wherein the speed of the projectile is controlled by gear driven opposing spindles disposed along the barrel. In each of these devices, the rate of projectile firing is limited to the rate at which individual projectiles can be loaded and the trigger pulled.

Other devices, typically used to practice sport skills, provide for the propelling of balls at regular intervals. Two examples are illustrated in U.S. Pat. Nos. 4,025,071 issued to Hodges; and 4,559,918 issued to Ballerin et al. In these devices, the balls are fed continuously into a pinch roller which projects them to the player. In such devices, there is no control of the rate of ball feed.

SUMMARY OF THE INVENTION

The present invention provides a gun for an amusement game which overcomes these limitations of the prior art. In particular, it provides a gun wherein the rate of projectile firing is controllable. In the preferred form, it provides a gun which stimulates the firing of a Gattling gun by the use of a hand-operated crank which varies the rate of projectile firing directly with the rate of crank rotation.

These advantages are provided by a gun comprising a projectile propelling device having a projectile feed inlet and feed outlet for propelling a projectile received in the inlet through the outlet; a supply providing serially a plurality of projectiles; a feeder coupled between the supply and the propelling device for receiving serially a plurality of projectiles from the supply and feeding them individually and serially into the projectile feed inlet. The feeder is controllable to vary the rate projectiles are fed into the feed inlet. Preferably, the rate is continuously and manually controlled by a crank mounted on the gun body to simulate operation of a Gattling gun.

These and other objects and advantages of the present invention will become apparent from a review of the drawings and the following detailed description of the preferred embodiment.

DETAILED DESCRIPTION OF THE PREFERRED EMBODIMENT

Figure 1:
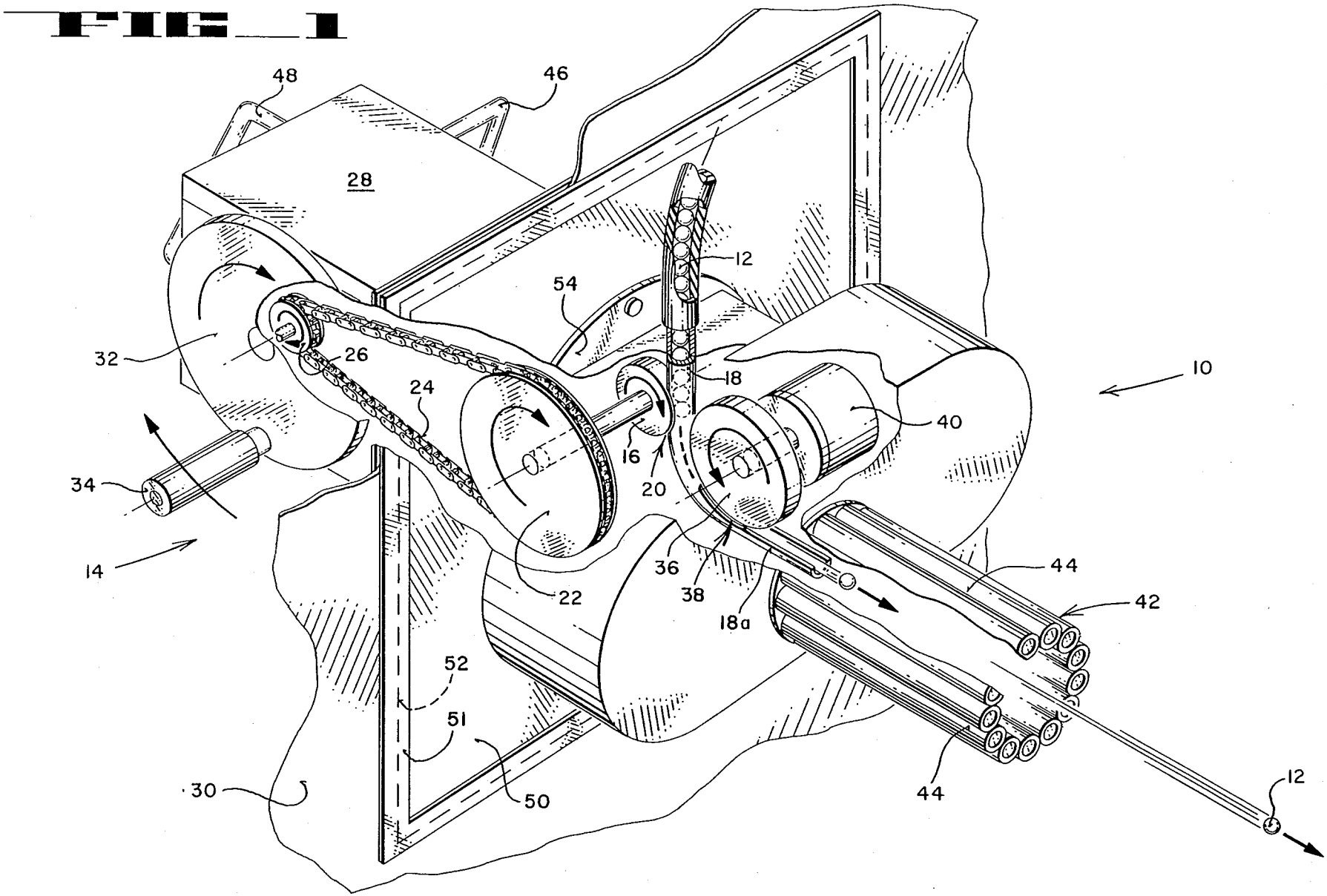
FIG. 1 is a perspective view of a gun made according to the present invention.

Referring initially to FIG. 1, a perspective view of a gun 10 made according to the invention is shown. Travel of a ball 12 to be propelled by the gun is controlled by a manually operated ball feed apparatus 14. Apparatus 14 includes a rotatable resilient pinch-roller 16 which extends into a portion of a ball-supply tube 18 to form a nip region 20. Region 20 is formed so that balls 12 cannot travel down tube 18 unless roller 16 rotates to move each ball through the nip region.

Roller 16 is attached to a sprocket wheel 22 which is drivingly connected by a loop link chain 24 to a drive sprocket wheel 26. Wheels 22 and 26 are rotatably mounted relative to a gun housing 28 which extends forwardly from a vertical mounting panel 30. Fixedly attached to wheel 26 is a crank wheel 32 positioned externally of housing 28. A crank handle 34 is attached along its periphery to wheel 32. The rotation of wheel 32 by crank handle 34 causes pinch-roller 16 to rotate at a corresponding rate. Thus, the crank can be used to completely control the feeding of balls along tube 18. If the crank is held in a fixed position, no balls are fed down the tube. If it is rotated quickly, a rapid series of balls are fed.

Balls released by roller 16 drop by gravity down an extension of tube 18 to a second pinch-roller or firing wheel 36 which also extends along its periphery into tube 18, creating a second nip region 38. Wheel 36 is rotated at 3000 rpm by a connected driving motor 40. During operation, motor 40 is constantly running so that as soon as a ball is released from nip region 20, it enters nip region 38 and is directed at a high rate of speed along the end 18*a* of the feed tube. End 18*a* extends into a large barrel 42 formed of circumferentially disposed smaller tubes 44 which give the appearance of a multibarrel Gattling-type gun. The balls actually travel out through the center of large barrel 42.

Opposite from crank wheel 32 on housing 28 is fixedly mounted a handle 46 which serves as a force countering and gun steadying support for the player operating gun 10. An alternate support handle 48 is disposed on the end or butt of housing 28 as shown. Housing 28 is attached to panel 30 by a resilient rubber diaphragm 50 held in place by a clamping frame 51. Diaphragm 50 is clamped to the margins of a rectangular opening 52 located in panel 30. The diaphragm has a central opening (not shown) in it through which housing 28 extends and to which the housing is in turn clamped by a pair of plates 54.

Diaphragm 50 is sufficiently thick to support the gun while allowing the gun to be rotated relative to panel 30. The diaphragm thus acts as a universal joint for pivoting the gun during aiming at the various targets during use. The diaphragm also acts as a barrier to prevent ricocheting balls from escaping through the panel. It also prevents tampering with the internal components of the gun by players using it.

Figure 2:
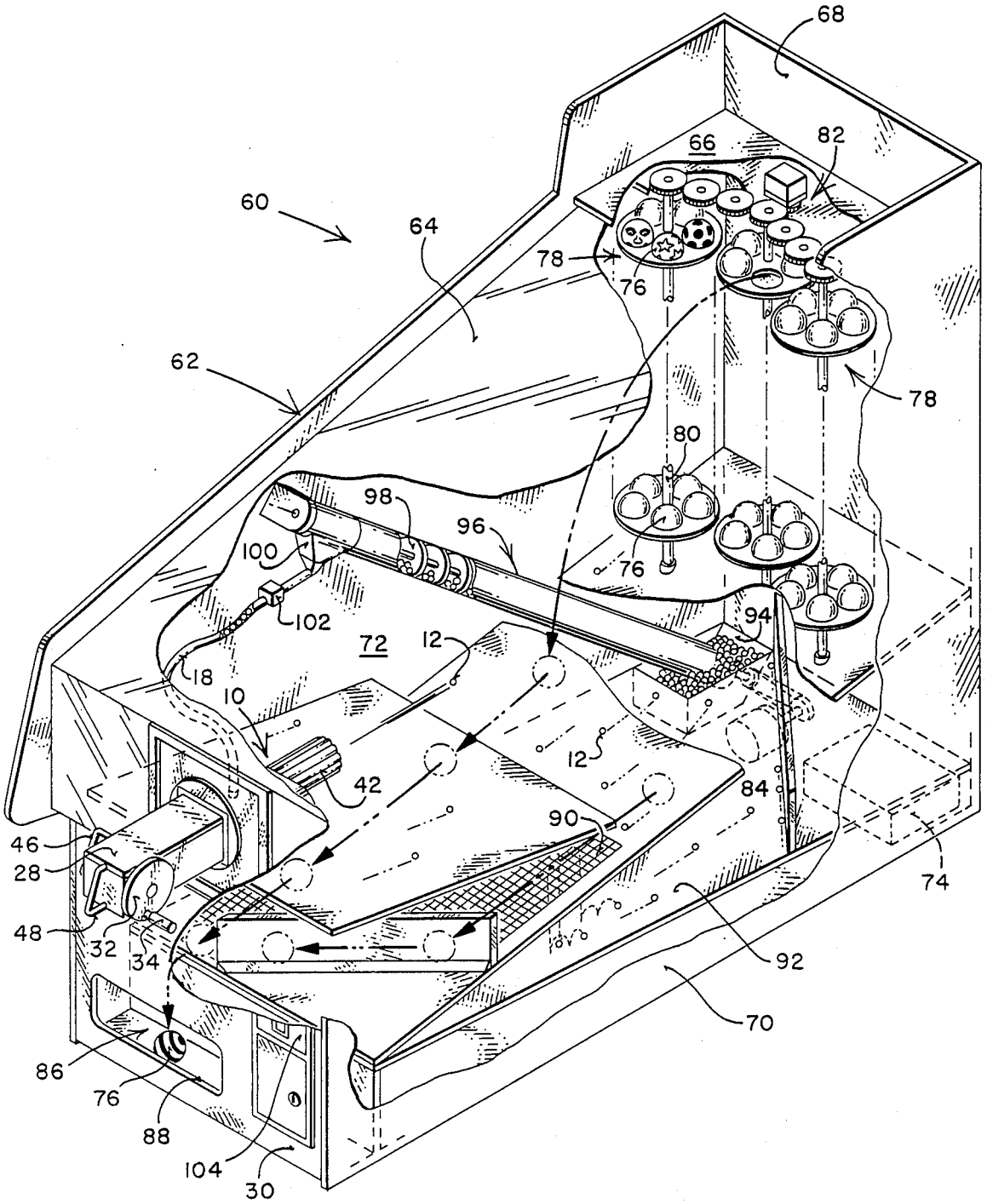
FIG. 2 is a partially fragmented, perspective view of an amusement game using the gun of FIG. 1.
Figure 3:
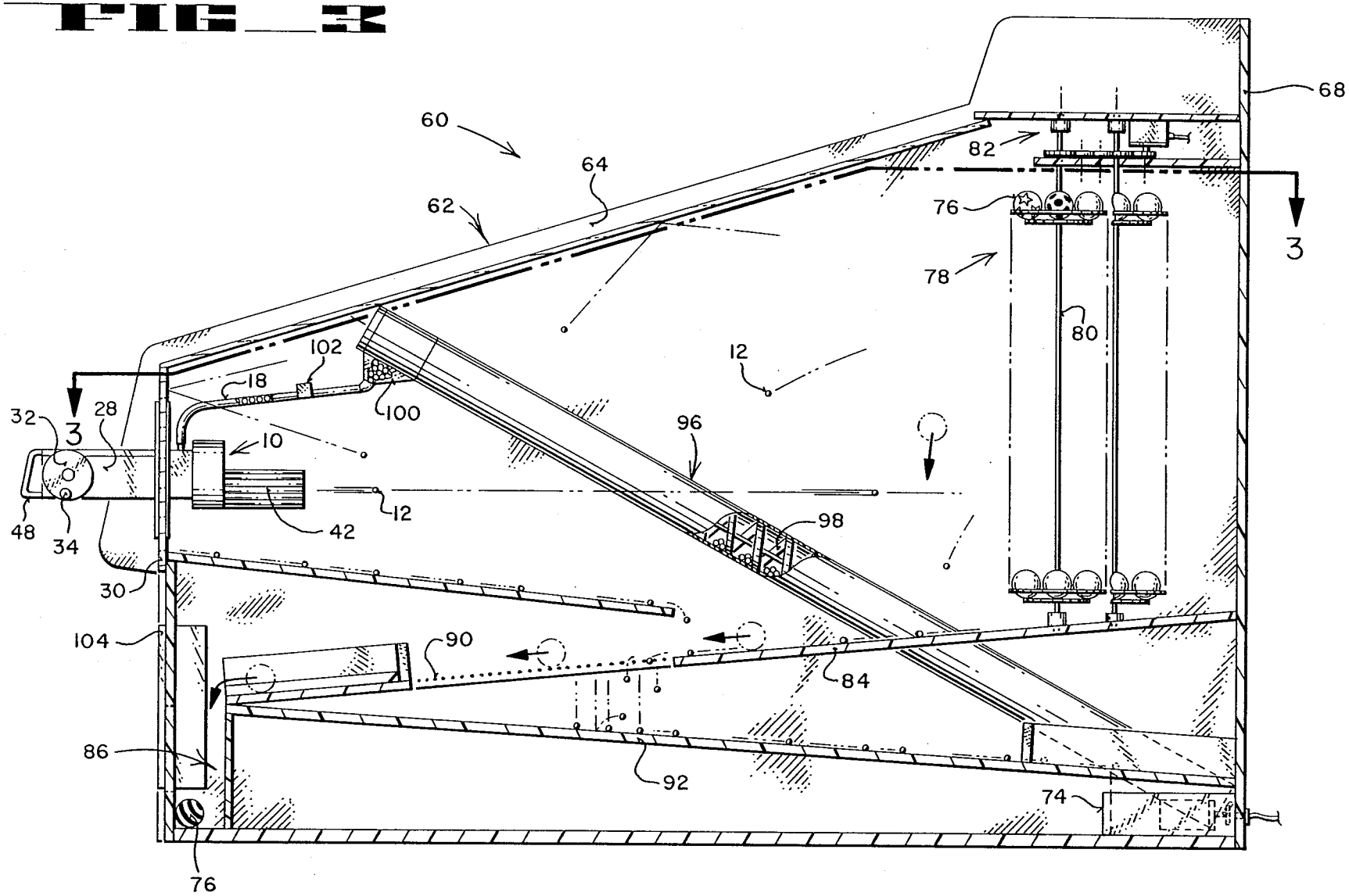
FIG. 3 is a side view in cross section of the game of FIG. 2.
Figure 4:
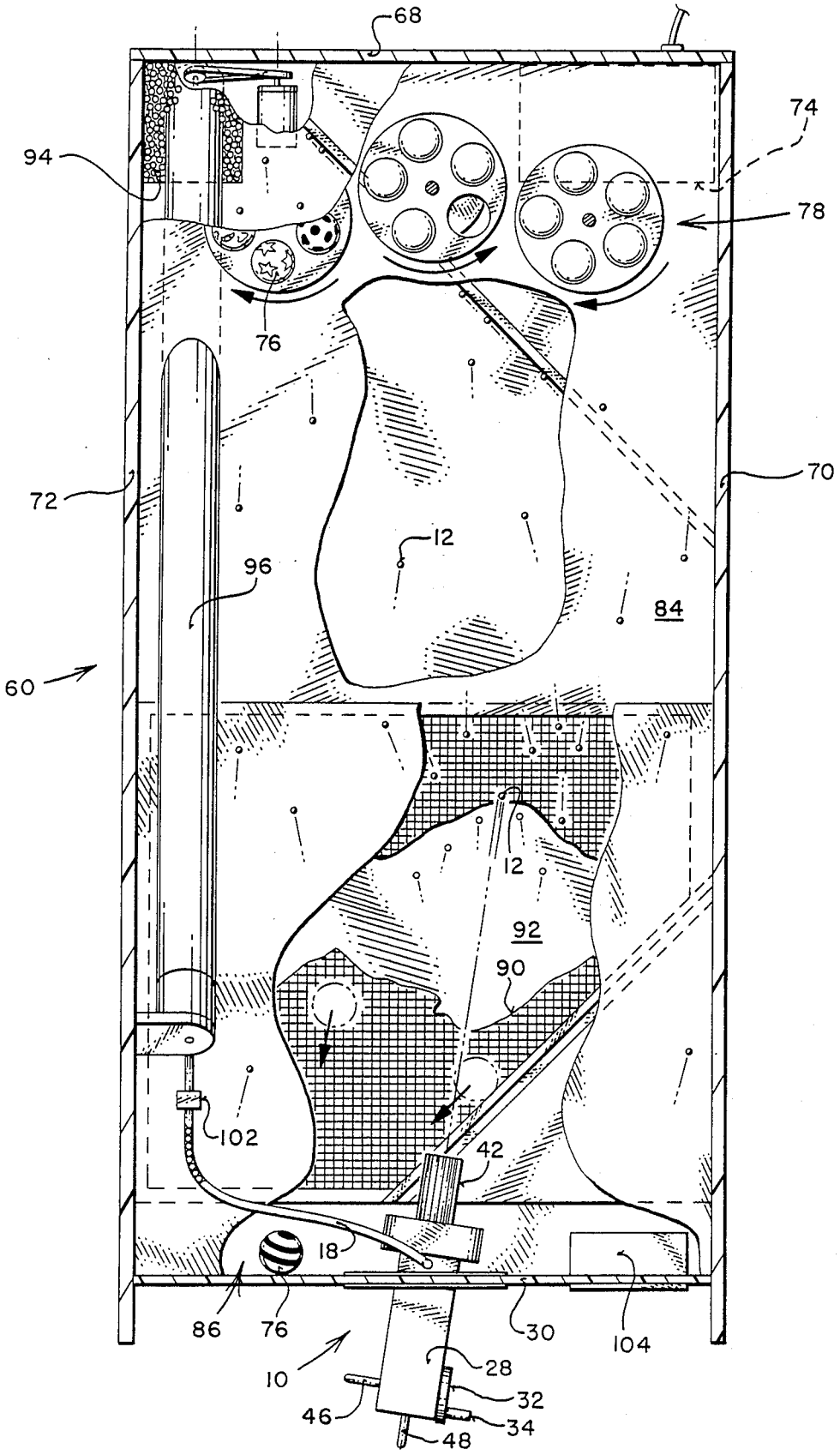
FIG. 4 is a cross-sectional view taken along line 4—4 in FIG. 3.

Referring now to FIGS. 2, 3 and 4, gun 10 is shown as used in an amusement game 60 made as described in our above-mentioned application. Game 60 includes an enclosure 62 having a top clear, impact resistant plastic cover 64 which slopes downwardly toward the front or left end, as viewed in the figures, to the top of panel 30. The enclosure also includes a top rear panel 66, a rear panel 68, and side panels 70 and 72. A power supply and controls are located in a box 74 located in the rear lower section of the unit.

The game includes a plurality of targets 76 which also becomes prizes when they are dislodged from their supports. The targets are supported on one of three carousels 78 in a manner allowing them to be dislodged when contacted by one or more balls in a predetermined manner as described in our copending application. Each carousel 78 includes a vertical rod 42 around which the supported targets rotate by a drive apparatus 82.

Targets which are dislodged from the carousel drop to a target delivery board 84 which has a slope forward and downward. The targets being generally round, roll under the force of gravity toward the front of enclosure 62. The targets end up adjacent the front panel 30 in a target dispensing station 86. An opening 88 extends through panel 30 in the lower left portion to provide access by a player to targets dislodged from the carousel and delivered to station 86.

The balls returning on board 84 which have been fired at targets supported on a carousel drop through a screen 90 to a ball return board 92 sloping downward to a box 94 which fills with the balls. A ball transfer system 96 transfers the balls from box 94 to gun 10 which is used to direct the balls toward supported targets. Transfer system 96 includes an Archimedes's spiral 98 having a lower end disposed in box 94 where balls are captured and delivered at its opposite end to a funnel 100.

Balls delivered to the top of spiral 98 are delivered to gun feed tube 18 via funnel 100. Disposed on the feed tube adjacent the funnel is a photodiode-based ball sensor 102. This sensor keeps track of the balls which travel past it in the tube. By conventionally known means, when a desired number of balls have been delivered to the feed tube and gun, the spiral is turned off to prevent further balls from being transferred to the feed tube. The specific count of balls is determined by the amount of money fed into a coin receptacle 104 mounted in the front of the enclosure adjacent the handle of the gun.

During operation of gun 10 in combination with amusement game 60, in a ready condition, feed tube 18 is filled with balls 12 and carousels 78 are loaded with a variety of targets 76. When coins are inserted into coin receptacle 104, the carousels are rotated, and motor 40 in gun 10 is turned on. The player then begins firing balls 12 by rotating crank handle 34 at a desired rate to release balls to nip region 38.

By firing balls in rapid succession by quickly rotating the crank handle, a plurality of balls can be directed at a single target. The direction of the projected balls is controlled by the player by pivoting the gun as desired. The cumulative momentum of well-aimed balls on the target, preferably against a lower surface of the round targets shown, dislodges it from the carousel.

With continued use of the gun, a player develops skill in aiming it, in knowing where to hit the targets, and in knowing how many hits are required to dislodge them. Thus, a skilled player is able to select a desired prize and more consistently dislodge it with fewer balls than is required by a less experienced player. The rate of awarding prizes is therefore directly proportional to the skill level of the player.

The dislodged target then drops to target delivery board 84 on which it rolls up to dispensing station 86 for pickup by the player. Balls fired at the targets also fall to board 84 and are returned to the gun.

It will thus be seen that an amusement game is provided wherein the player is able to control the rate of firing at targets in a Gattling-gun-like manner. Although a single embodiment has been described, it will be appreciated that other variations in form and detail may be made without departing from the spirit and scope of the invention as defined in the claims.

We claim:

1. A gun for propelling a plurality of projectiles at a predetermined rate, comprising:

means having a projectile feed inlet and feed outlet for propelling a projectile received in said inlet through said outlet;

supply means providing serially a plurality of projectiles;

feeder means coupled between said supply means and said propelling means for receiving serially a plurality of projectiles from said supply means and feeding them individually and serially into the projectile feed inlet, said feeder means being manually controllable to vary the rate projectiles are fed into said feed inlet, wherein said feeder means includes a manually rotatable crank means, wherein the rate of object feed is proportional to the rate of crank means rotation, and wherein said feeder means includes a pinch roller forming a first nip region disposed to receive projectiles from said supply means and drivingly coupled to said crank means, whereby rotation of said crank means rotates said pinch roller; and said propelling means being coupled to said feeder means downstream of said pinch roller and including a second pinch roller forming a second nip region and motor means for rotating said second pinch roller at a predetermined speed.

2. A gun for propelling a plurality of projectiles at a predetermined rate, comprising:

means having a projectile feed inlet and feed outlet for propelling a projectile received in said inlet through said outlet;

supply means providing serially a plurality of projectiles;

feeder means coupled between said supply means and said propelling means for receiving serially a plurality of projectiles from said supply means and feeding them individually and serially into the projectile feed inlet, said feeder means being manually controllable to vary the rate projectiles are fed into said feed inlet; and a vertically disposed panel for supporting said feeder means and propelling means, said panel having an opening through which said feeder means and propelling means extend, and resilient means mounted on said panel for supporting said feeder and propelling means in a manner allowing pivoting of said feeder and propelling means.

3. A gun for propelling serially a plurality of projectiles, comprising:

supply means providing serially a plurality of projectiles;

projectile feed tube means coupled to said supply means for receiving said projectiles and defining a travel path along which projectiles travel by gravitational force, said feed tube means including an opening exposing a portion of said travel path;

a pinch roller disposed adjacent said feed tube opening for forming a nip region through which projectiles pass in traveling along said travel path, said pinch roller being rotatable with respect to said feed tube, a manually rotatable crank drivingly coupled to said pinch roller for rotating said roller in a manner transporting projectiles received in said feed tube through said nip region; and means coupled to said feed tube downstream from said nip region for propelling a projectile received from said nip region in a predetermined direction at a predetermined rate, wherein said propelling means includes a second pinch roller forming a second nip region in said feed tube, and motor means for rotating said second pinch roller at a predetermined speed.

* * * * *